US012123172B2

(12) United States Patent
Nakajima et al.

(10) Patent No.: US 12,123,172 B2
(45) Date of Patent: Oct. 22, 2024

(54) BOOM CONTROL CIRCUIT FOR A CONSTRUCTION MACHINE

(71) Applicant: Caterpillar SARL, Geneva (CH)

(72) Inventors: Hideki Nakajima, Akashi (JP); Koichi Kiyasu, Akashi (JP)

(73) Assignee: Caterpillar SARL, Geneva (CH)

( * ) Notice: Subject to any disclaimer, the term of this patent is extended or adjusted under 35 U.S.C. 154(b) by 49 days.

(21) Appl. No.: 17/924,909

(22) PCT Filed: Apr. 30, 2021

(86) PCT No.: PCT/EP2021/025168
§ 371 (c)(1),
(2) Date: Nov. 11, 2022

(87) PCT Pub. No.: WO2021/228431
PCT Pub. Date: Nov. 18, 2021

(65) Prior Publication Data

US 2023/0183945 A1 Jun. 15, 2023

(30) Foreign Application Priority Data

May 11, 2020 (JP) ..... 2020-083128

(51) Int. Cl.
*E02F 9/22* (2006.01)
*E02F 3/43* (2006.01)

(52) U.S. Cl.
CPC ..... *E02F 9/2203* (2013.01); *E02F 3/435* (2013.01); *E02F 9/2267* (2013.01); *E02F 9/2285* (2013.01); *E02F 9/2296* (2013.01)

(58) Field of Classification Search
None
See application file for complete search history.

(56) References Cited

U.S. PATENT DOCUMENTS 10,081,928 B2 * 9/2018 Wu ..... E02F 9/2292
11,162,245 B2 * 11/2021 Nakajima ..... E02F 9/2217
(Continued)

FOREIGN PATENT DOCUMENTS

JP 118692 Y2 5/1989
JP 2004301214 A 10/2004
(Continued)

OTHER PUBLICATIONS

International Search Report related to Application No. PCT/EP2021/025168; reported on Jun. 9, 2021.

*Primary Examiner* — Kenneth Bomberg
*Assistant Examiner* — Michael Quandt

(57) ABSTRACT

To perform a work with the same operability under a dead weight of a front work equipment in any of a float work and a normal work, when a bucket descends in the air, and after contacting the ground, to perform a work with the operability being maintained as it is when performing the float work, and to perform a work while pressurized hydraulic fluid is supplied from a hydraulic pump when performing the normal work. A lower-ing control during a float working mode is performed in a valve passage state in a first region at which the lowering control is performed under the dead weight of the from work equip-ment without being supplied with hydraulic fluid from the hydraulic pump, regardless of whether or not the bucket is in contact with the ground, and the lowering control during a normal working mode is performed in a valve passage state at the first region in a non-ground-contacting state and at a second region in which the hydraulic fluid can be supplied from the hydraulic pump in a ground-contacting state.

2 Claims, 7 Drawing Sheets

(56) References Cited

U.S. PATENT DOCUMENTS

| | | | | |
|---|---|---|---|---|
| 11,280,059 | B2 * | 3/2022 | Mori | E02F 3/844 |
| 11,585,068 | B2 * | 2/2023 | Nakajima | E02F 3/435 |
| 2015/0322648 | A1 | 11/2015 | Lee | |

FOREIGN PATENT DOCUMENTS

| | | | | |
|---|---|---|---|---|
| WO | WO-2008078930 | A1 * | 7/2008 | E02F 3/437 |
| WO | 2013103954 | A2 | 7/2013 | |
| WO | WO-2018234339 | A1 * | 12/2018 | E02F 3/435 |

* cited by examiner

BOOM CONTROL CIRCUIT FOR A CONSTRUCTION MACHINE

CROSS-REFERENCE TO RELATED APPLICATION

This Application is a 35 USC § 371 US National Stage filing of International Application No. PCT/EP2021/025168 filed on Apr. 30, 2021 which claims priority under the Paris Convention to Japanese Patent Application No. 2020-083128 filed on May 11, 2020.

FIELD OF THE INVENTION

The present invention relates to a technical field of a boom control device in a construction machine comprising a boom that is movable upwardly and downwardly in accordance with the extending and contracting operation of a boom cylinder in a construction machine such as a hydraulic excavator.

BACKGROUND OF THE INVENTION

Generally, among construction machines, there are some such as hydraulic excavators, which are configured such that a front work equipment mounted on a machine body comprises a boom with a base end portion being supported on the machine body in a vertically swingable manner; a stick (arm) supported on a leading end portion of the boom in a longitudinally swingable manner; and a work attachment such as a bucket supported on the leading end portion of the stick in a longitudinally (vertically) swingable manner, and the boom, the stick, and the work attachment are configured to operate by extending and contracting operation of respective corresponding cylinders so that the necessary works can be performed.

In such a construction machine, if the work attachment is a bucket for example, in addition to normal works such as digging work using the bucket, spreading and grading work (leveling work) of the ground surface (working plane, ground-contact plane) using the bucket in contact with ground surface may be performed. Such works will be performed while maintaining the bucket in contact with the ground surface under a dead weight of the front work equipment without being supplied with hydraulic oil (pressurized oil) from the hydraulic pump. Works performed in this way while the work attachment such as a bucket in contact with the ground under the dead weight of the front work equipment include crushing and boring works of rock, concrete debris etc. using breakers for example, and collection works (sweeping and gathering works) for gathering dumped materials (for example, wastes) which are scattered on the ground surface, in addition to the aforesaid spreading and grading work. Such a work which is performed by causing the work attachment to contact the ground under the dead weight of the front work equipment may be generally referred to as "float work". As thus represented hereinbelow, original work which is performed in a state where the front work equipment can receive the hydraulic oil from the hydraulic pump will be distinguished as "normal work". And the work modes selected to perform these works will be referred to as "float working mode" and "normal working mode".

Meanwhile, as a control valve provided for controlling the extension and contraction of the boom cylinder, a spool valve is generally used, which is capable of switching to three positions: a neutral position at which the extension and contraction of the boom cylinder is stopped, a raising-side operating position at which the boom cylinder is extended, and a lowering-side operating position at which the boom cylinder is contracted. In order to enable the float work to be performed in a construction machine comprising such a control valve, an attempt is made to provide a switching valve dedicated to the float work apart from the control valve. However, if it is done in this way, there arises a problem that the number of valves increases and the valve switching control is required accordingly, which leads to complicatedness of operation. Besides, in this case, when performing a lowering operation of the boom, a lowering control by the control valve is performed for the aforesaid normal work, while a lowering control by the aforesaid dedicated switching valve is performed for the float work. Therefore, it follows that the lowering control by using different valves will be performed, and the operability becomes different. Thus, not only an operator feels a sense of discomfort in operation but also there arises another problem that a shock may occur. More specifically, for example, during the lowering operation while the bucket is located in the air, if a mode switching is performed from the normal working mode to the float working mode, then an oil passage switching will be performed by using the aforesaid different valves, which may cause a shock.

To cope with this problem, it has been proposed to use the control valve serving as a spool valve, with the supply of the hydraulic oil (pressurized oil) from the hydraulic pump being cut off, capable of performing four-position switching provided with a float operating position at which a valve passage is formed so that oil passages that are connected to a rod end oil chamber, a head end oil chamber of the boom cylinder, and the oil tank are in communication with each other (see, for example, Patent Literatures 1 and 2).

PRIOR ART LITERATURES

Patent Literatures

PATENT LITERATURE 1: Japanese Utility Model Publication No. 1-18692

PATENT LITERATURE 2: Japanese Patent Application Laid-Open No. 2004-301214

SUMMARY OF THE INVENTION

Problems to be Solved by the Invention

Meanwhile, in all of the aforesaid conventional ones, a valve passage at the float operating position is configured to couple the oil passages of the rod end oil chamber, the head end oil chamber of the boom cylinder, and the oil tank in a free state (a state where the flow rate control is not available). For this reason, when the control valve is switched to the float operating position in order to perform a float work, the hydraulic oil would suddenly flow in the valve passage in the free state (without the flow control being performed). As a result, if the work mode is switched to the float working mode while the bucket is located in the air, then the boom cylinder directly receives the dead weight of the front work equipment and would perform sudden contracting operation, and there arises a problem that the bucket contacts the ground in an almost dropping state.

Thus, in order to avoid this trouble, it is also proposed to configure the control valve so as to be capable of performing flow rate control even when it is switched to the float operating position. If a dedicated flow rate control valve is provided, in order to deal with this proposal, the number of valves would increase and there arises the same problem as the case when the control valve serves as the aforesaid three-position switching spool valve.

In contrast, it is also proposed to adopt a configuration in which the aforesaid dedicated flow ratr control valve is not required by providing the float operating position of the control valve with the flow rate control function. Given that it is done in this way, however, the lowering operation of the boom would be performed at a lowering-side operating position in the normal working mode, and would be performed at the float operating position in the float working mode, that is, different valve passages would be used. As a result, not only operability of the boom lowering operation in each work mode would be different and an operator would feel a sense of discomfort, but also there is still problem such as a shock occurring when the work mode is switched during the lowering operation while the bucket is located in the air, and these are the problems to be solved by the present invention.

Means for Solving the Problems

The present invention has been created with an aim of solving these problems in view of the actual circumstances as described above. The invention of claim 1 is a boom control device in a construction machine, the construction machine comprises:

a front work equipment with a boom being supported by a machine body so as to be swingable upwardly and downwardly;

a boom cylinder configured to cause the boom to swing upwardly and downwardly;

a control valve configured to perform extension and contraction control of the boom cylinder;

a control unit configured to perform a switching control of the control valve;

a ground-contact detecting means for detecting a ground-contact of a work attachment provided at a leading end portion of the front work equipment; and a control unit configured to output a control command to the control valve in response to a manipulation of a manipulation tool, the construction machine is configured such that:

the control unit is set to be capable of switching work modes of the front work equipment between a normal working mode that is set at a time of a normal work in which a lowering control of the front work equipment is performed in a state where a hydraulic oil supply from a hydraulic pump is possible, and a float working mode that is set at a time of a float work performed in a state where the hydraulic oil supply from the hydraulic pump is shut off, and a dead weight of the front work equipment is received, and the control valve is capable of making a valve position switching among a neutral position at which the extension and contraction of the boom cylinder is stopped, a raising-side operating position at which the boom cylinder is extended to raise the boom, and a lowering-side operating position at which the boom cylinder is contracted to lower the boom, in response to the control command from the control unit, wherein:

the control valve comprises, at the lowering-side operating position, a discharge valve passage that allows the hydraulic oil in a head end oil chamber of the boom cylinder to be discharged into an oil tank; a regeneration valve passage with a check valve that allows the hydraulic oil in the head end oil chamber to be supplied to a rod end oil chamber; and a supply valve passage for supplying the hydraulic oil from the hydraulic pump to the rod end oil chamber; wherein there are provided a first region and a second region, and the hydraulic oil supply from the hydraulic pump by the supply valve passage is shut off at the first region and allowed at the second region, if the work mode when the control valve is positioned at the lowering-side operating position is in the normal working mode, the control unit is set to perform a lowering control at the first region when the ground-contact detecting means is in a ground-contact non-detected state, and performs the lowering control at the second region when the ground-contact detecting means is in a ground-contact detected state;

if the work mode when the control valve is positioned at the lowering-side operating position is in the float working mode, the control unit is set to perform the lowering control at the first region notwithstanding the ground-contact detected state by the ground-contact detecting means.

The invention of claim 2 is the boom control device in a construction machine according to claim 1, wherein the control unit is configured to control so that the hydraulic pump is set into an unload state when the control valve is positioned at the first region.

Favorable Effects of the Invention

According to the invention of claim 1, in a float working mode, even when performing a float work with a work attachment in contact with the ground from a state of being located in the air, a lowering control continues to be performed at a first region at which the hydraulic oil supply from the hydraulic pump is shut off;

on the other hand, in a normal working mode, in a ground-contact non-detected state where the work attachment is located in the air, a lowering control is performed at the first region at which the hydraulic oil supply is shut off similarly to the float working mode, and when entering the ground-contact detected state, a lowering control with the hydraulic oil supply from the hydraulic pump being available by the second region will be performed; as a result, the lowering control when the work attachment is lowered in the air will be performed in the valve passage of the same first region for both the float working mode and the normal working mode, and thus the operability is unified and the lowering operation of the front work equipment without sense of discomfort can be performed. Then, when a work is performed with the front work equipment in contact with the ground, in the float working mode, the lowering control by the same first region as when lowering will be continuously performed, and the float work can be performed smoothly without valve passage switching. Further, in the normal working mode, after contacting the ground, it is possible to perform powerful work while receiving the hydraulic oil supply from the hydraulic pump, which improves workability and operability.

According to the invention of claim 2, when the front work equipment is located in the air and the control valve is at the first region, the hydraulic pump is controlled to an unload state in which effective hydraulic oil supply to the control valve side is not available, regardless of the float working mode or the normal working mode, and thus energy saving can be achieved accordingly.

DETAILED DESCRIPTION OF THE INVENTION

Figure 1:
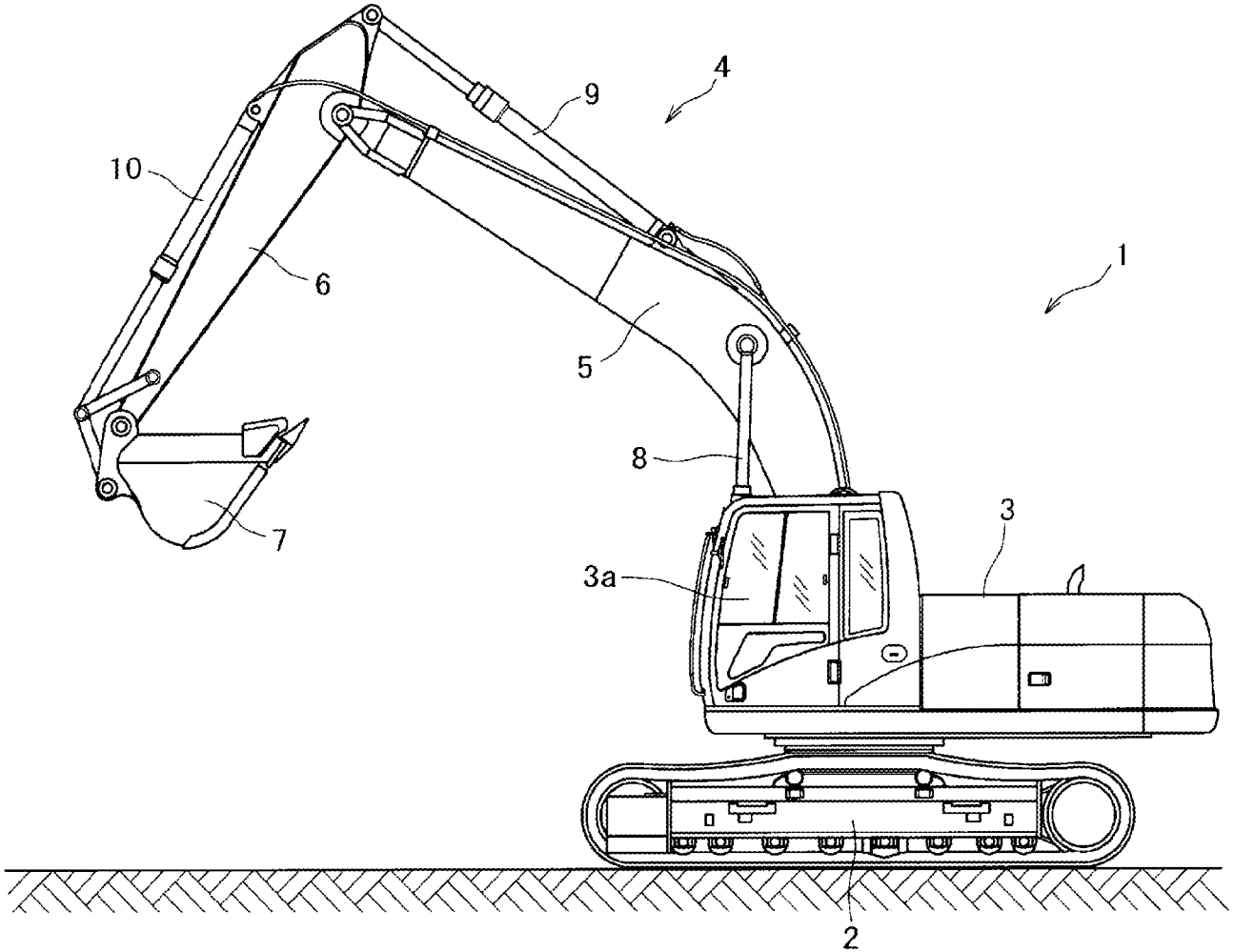
FIG. 1 is a side view of a hydraulic excavator.

Hereinbelow, embodiments for implementing the present invention will be described with reference to the accompanying drawings. In the figures, reference numeral 1 denotes a hydraulic excavator which is an example of a construction machine, and the hydraulic excavator 1 is configured to comprise a crawler type lower traveling structure 2; an upper revolving structure 3 which is revolvably supported above the lower traveling structure 2; a front work equipment 4 and other various member equipment mounted on the upper revolving structure 3.

The front work equipment 4 comprises a boom 5 with its base end portion being pivoted so as to be upwardly and downwardly swingable on the upper revolving structure 3, and a stick (arm) 6 with its base end portion being pivoted on a leading end portion of the boom 5 so as to be forwardly and backwardly swingable, a bucket (an example of a work attachment) 7 and other various member equipment swingably attached to a leading end portion of the stick 6. The hydraulic excavator 1 configured in this way comprises a boom cylinder 8, a stick cylinder 9, and a bucket cylinder 10 for causing the boom 5, the stick 6, and the bucket 7 to swing respectively; and further comprises left and right traveling motors (not illustrated) for causing the lower traveling structure 2 to travel and a revolving motor (not illustrated) for revolving the upper revolving structure 3, and other various types of hydraulic actuators. These configurations are similar to the conventional ones. Since the present invention relates to the raising and lowering operations of the boom 5, the matters related to the raising and lowering operations of the boom 5 will be described in detail below, and the description of operation of the remaining stick 6, the bucket 7, the traveling motors, the revolving motor, and other hydraulic actuators will be omitted.

The boom cylinder 8 is configured to comprise a head end oil chamber 8*a* without a cylinder rod 8*c* and a rod end oil chamber 8*b* with a cylinder rod 8*c*. The boom cylinder 8 is configured such that the boom 5 is raised (moved upwardly) by extending the cylinder by supply of hydraulic oil (pressurized oil) to the head end oil chamber 8*a* and discharge of hydraulic oil (drain oil) from the rod end oil chamber 8*b*, while the boom 5 is lowered (moved downwardly) by contracting the cylinder by supply of the hydraulic oil to the rod end oil chamber 8*b* and discharge of the hydraulic oil from the head end oil chamber 8*a*. Then, the supply and discharge control of the hydraulic oil to and from the boom cylinder 8 will be described below.

Figure 2:
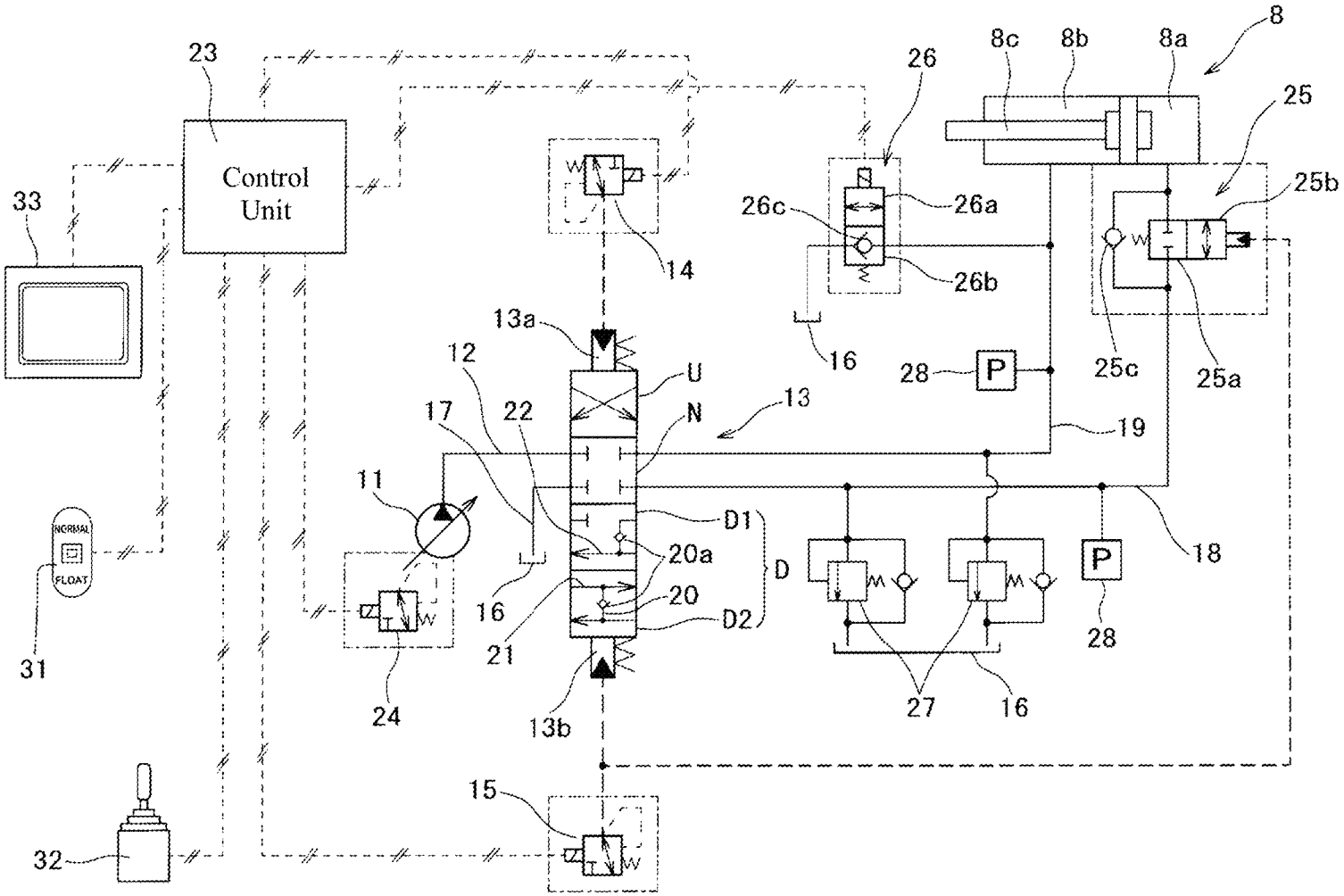
FIG. 2 is a hydraulic circuit diagram for controlling extension and contraction of a boom cylinder.

In FIG. 2, reference numeral 11 denotes a hydraulic pump that serves as a supply source of the hydraulic oil to the boom cylinder 8, and the hydraulic oil (discharged oil, pressurized oil) discharged from the hydraulic pump 11 is adapted to be supplied to a control valve 13 for the boom via a pump oil passage 12. The control valve 13 is configured as a three-position switching spool valve that can be switched to three valve positions: a neutral position N, a raising-side operating position U, and a lowering-side operating position D, by receiving a supply control of a pilot oil (pilot pressurized oil) from a raising-side and a lowering-side pilot valves 14, 15 to respective corresponding raising-side and lowering-side pilot ports 13*a*, 13*b*. Of course, the control valve 13 acts as a flow rate control valve that allows the flow rate control be performed by the opening areas of the valve passages being varied widely or narrowly in association with spool displacement amounts (movement amount) based on the supply control of the pilot oil, at the raising-side operating position U and the lowering-side operating position D.

The control valve 13 is connected to a tank oil passage 17 coupled to the oil tank 16, a head end oil passage 18 coupled to the head end oil chamber 8*a*, and a rod end oil passage 19*a* coupled to the rod end oil chamber 8*b*, in addition to the pump oil passage 12. When the control valve 13 is positioned at the neutral position N, a valve passage is formed so as to shut off the hydraulic oil supply from the hydraulic pump 11 to the boom cylinder 8 side, and to shut off the hydraulic oil discharge from the boom cylinder 8 to the oil tank 16. This allows the boom cylinder 8 to be set so that a stop control of the extending and contracting operation is performed.

On the other hand, when the control valve 13 is positioned at the raising-side operating position U, a valve passage is formed so as to communicate the pump oil passage 12 and the head end oil passage 18 with each other to supply the hydraulic oil from the hydraulic pump 11 to the head end oil chamber 8*a*; on the other hand, to communicate the rod end oil passage 19 and the tank oil passage 16 with each other to discharge the hydraulic oil in the rod end oil chamber 8*b* into the oil tank 16, and thereby, when the control valve 13 is switched to the raising-side operating position U, the control valve 13 is set so that a raising control to raise the boom 5 by extending the boom cylinder 8 is performed.

In contrast, in the lowering-side operating position D provided in the control valve 13, there are provided a regeneration valve passage 20 with a check valve 20*a* that opens or closes a valve passage so as to connect the head end oil passage 18 and the rod end oil passage 19 with each other and to supply the hydraulic oil from the head end oil passage 18 to the rod end oil passage 19 in a non-return state; a supply valve passage 21 that allows the hydraulic oil to be supplied from the hydraulic pump 11 to the rod end oil chamber 8*b* by communicating the pump oil passage 12 and the rod end oil passage 19 with each other; and a discharge valve passage 22 that allows the hydraulic oil to be discharged from the head end oil chamber 8*a* to the oil tank 16 by communicating the tank oil passage 17 and the head end oil passage 18 with each other. Furthermore, in the lowering-side operating position D, the first region D1 and the second region D2 are provided, which are set by the spool displacement amount being varied in association with the work mode as will be described below.

Figure 3:
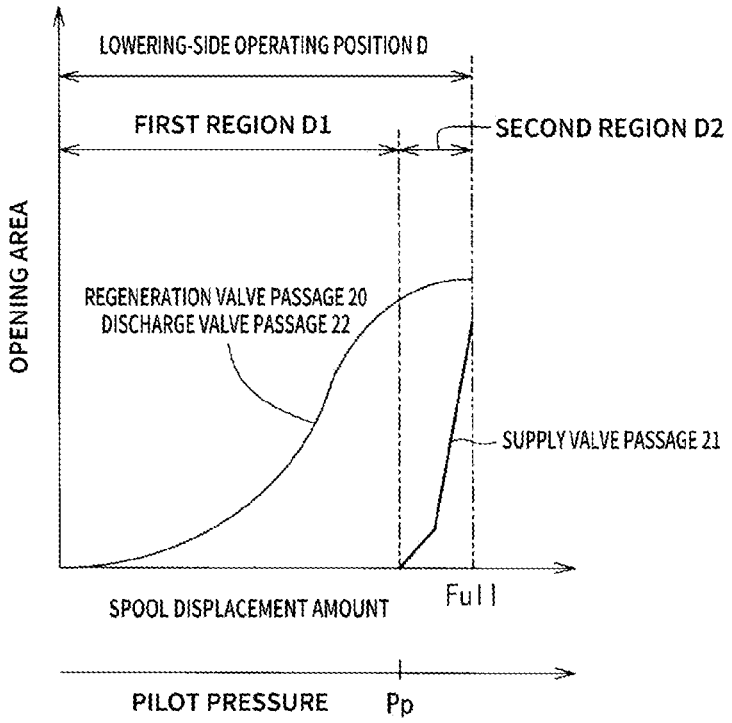
FIG. 3 is a graph diagram representing opening characteristics of a first region, a second region at a lowering-side operating position of a control valve.
Figure 4:
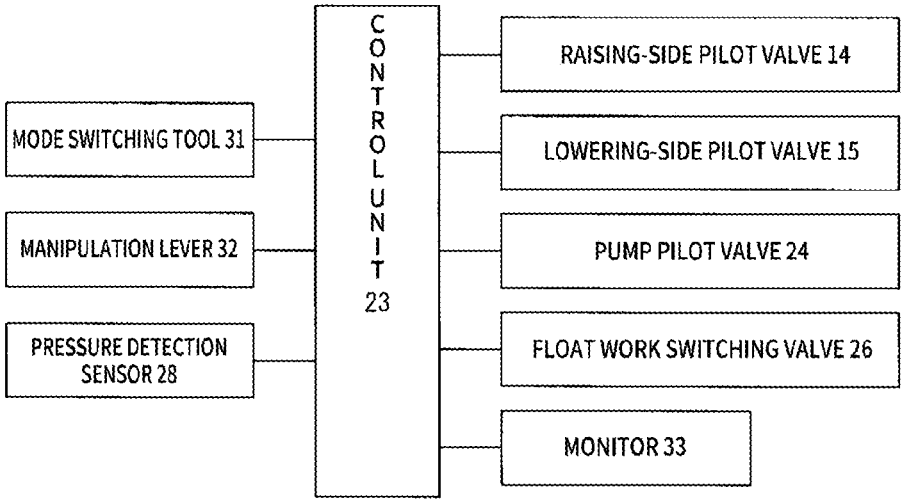
FIG. 4 is a block diagram of a control circuit.
Figure 5:
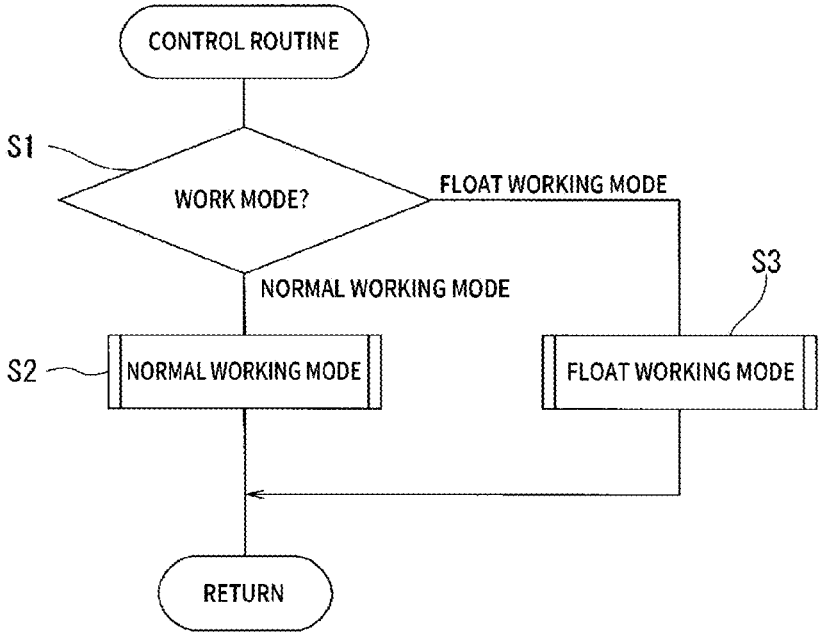
FIG. 5 is a flowchart illustrating a procedure of a main control of a control unit.
Figure 6:
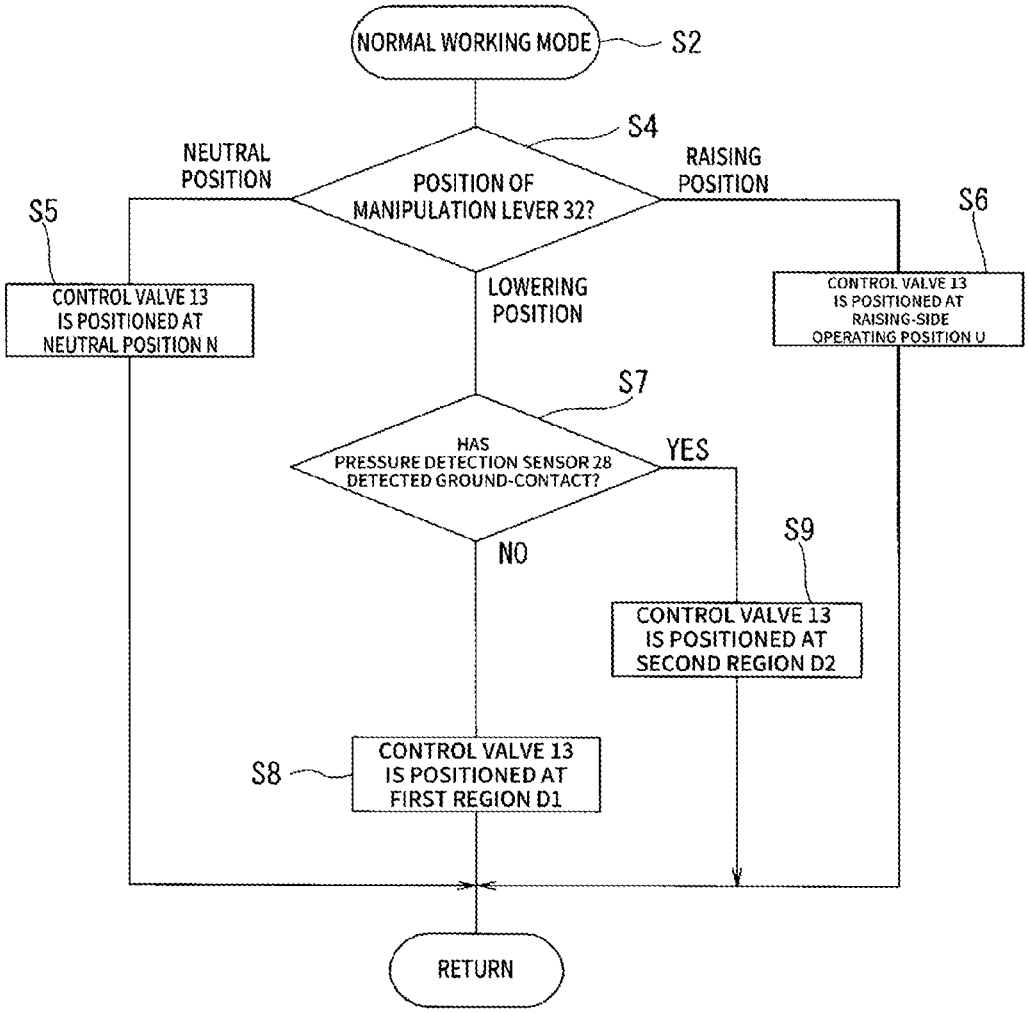
FIG. 6 is a flowchart illustrating a procedure of a boom raising/lowering control in a normal working mode of the control unit.
Figure 7:
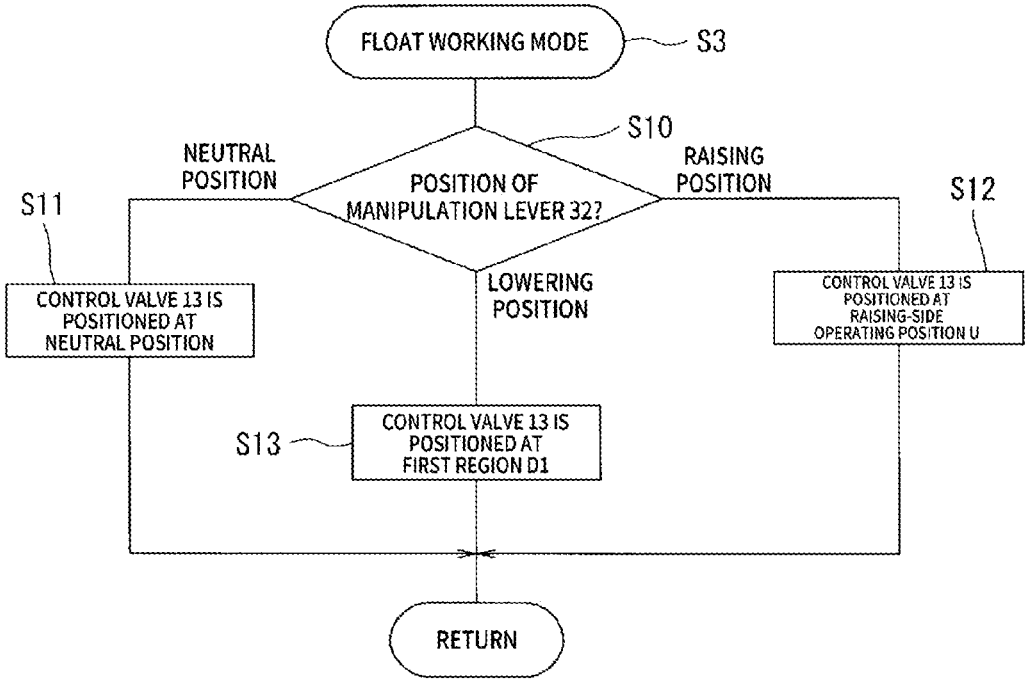
FIG. 7 is a flowchart illustrating a procedure of a boom raising/lowering control in a float working mode of the control unit.

At the first and second regions D1 and D2 provided in the lowering-side operating position D, as illustrated in FIG. 3, the opening areas of the valve passages are controlled to be wider or narrower in association with the spool displacement amounts, but the spool displacement amounts at the first and second regions D1 and D2 will be executed by control commands from the control unit 23 as will be described below.

The regeneration valve passage 20 and the discharge valve passage 22 are set so that the change in the opening areas of the valve passages corresponding to the change in the spool displacement amounts is varied together in the same relationship.

Then, in a state where the control valve 13 is positioned at the first region D1, the supply valve passage 21 is shut off and is in a closed state, but the regeneration valve 20 with the check valve passage 20*a* and the discharge valve passage 22 are in an open state. This allows to configure such that the hydraulic oil in the head end oil chamber 8*a* is supplied from the head end oil passage 18 to the rod end oil chamber 8*b* routed through the regeneration valve passage 20 and the rod end valve passage 19, and is discharged to the oil tank 16 routed through the discharge valve passage 22, the tank oil passage 17; on the other hand, the hydraulic oil supply from the hydraulic pump 11 to the rod end oil chamber 8*b* is shut off (closed) because the supply valve passage 21 is closed.

As a result, when the control valve 13 is positioned at the first region D1 of the lowering-side operating position D, the head end oil passage 18 communicates with the rod end oil passage 19 and the tank oil passage 17, in a state where the hydraulic oil supply from the hydraulic pump 11 is shut off, and thereby the hydraulic oil in the head end oil chamber 8*a* is supplied to the rod end oil chamber 8*b*, and discharged to the oil tank 16. In other words, as will be described below, the control valve 13 is set so that, by receiving the dead weight of the front work equipment 4, the hydraulic oil discharged from the head end oil chamber 8*a* can be supplied to the rod end oil chamber 8*b* via the regeneration valve passage 20, but the hydraulic oil that becomes surplus due to the presence of the cylinder rod 8*c* in the rod end oil chamber 8*b* can be discharged to the oil tank 16, and thereby the boom cylinder 8 is contracted on the basis of receiving the dead weight of the front work equipment 4 in a state where the hydraulic oil supply from the hydraulic pump 11 is not available, so as to perform the lowering operation control of the boom 5.

In contrast, in a state where the control valve 13 is positioned at the second region D2 of the lowering-side operating position D, the supply valve passage 21 is also opened in addition to the regeneration valve passage 20 and the discharge valve passage 22, and thereby the supply of the hydraulic oil from the head end oil chamber 8*a* to the rod end oil chamber 8*b* and the discharge to the oil tank 16 are allowed; on the other hand, the hydraulic oil from the hydraulic pump 11 is controlled to be supplied to the rod end oil chamber 8*b*.

As a result, in a state where the control valve 13 is positioned at the second region D2 of the lowering-side operating position D, the control valve 13 is set so that the boom cylinder 8 is contracted in a state where the hydraulic oil is supplied from the hydraulic pump 11, and thus to perform the lowering control of the boom 5 in a power state where digging work can be performed.

Furthermore, the head end oil passage 18 is provided with an anti-descend (drop) valve 25 in a state of being attached to the boom cylinder 8, and upon receiving the supply of the pilot oil from the lowering-side pilot valve 15, the anti-descend valve 25 is switched between valve positions from a closed position 25*a* at which there is no movement of the hydraulic oil to a communication position 25*b* at which the hydraulic oil can move to each other. This allows the anti-descend (drop) valve 25 to be positioned at the closed position 25*a* so that the head end oil passage 18 is closed from the source, when the pilot oil is not supplied from the lowering-side pilot valve 15, that is, when the control valve 13 is positioned at the valve position of the neutral position N, the raising-side operating position U other than the lowering-side operating position D. Consideration is given so that any defect such as inadvertent lowering of the boom 5 can be prevented, when the hydraulic oil would leak due to an abnormality occurrence such as damage to the control valve 13 or the piping, for example.

Furthermore, the anti-descend valve 25 is provided with a check valve 25*c* so as to supply the hydraulic oil only from the head end oil passage 18 to the head end oil chamber 8*a* side.

In contrast, when the work mode is set to the float working mode as will be described below, the rod end oil passage 19 is provided with a float work switching valve 26 that can be switched from a make-up position 26*b*, which is provided with a check valve 26*c* to supply the hydraulic oil in the oil tank 16 to the rod end oil chamber 8*b* side in response to a command from the control unit 23, to a communication position 26*a* at which the oil tank 16 and the rod end oil passage 19 are communicated with each other. Furthermore, the head end oil passage 18 and the rod end oil passage 19 are provided with line relief valves 27 each having a make-up function and pressure detection sensors 28 for detecting the pressure of each of the oil passages 18 and 19, respectively.

On the other hand, a driver's cab (cab) 3*a* of the upper revolving structure 3 is provided with a mode switching tool 31, a manipulation lever (manipulation tool) 32, a monitor 33 for displaying a screen. The control unit 23, upon receiving input signals from the mode switching tool 31, the manipulation lever 32, executes mode switching control between the normal working mode and the float working mode of the work modes in response to the input signal, and outputs control signals required for the raising/lowering-side pilot valves 14, 15, the float work switching valve 26, thereby executing the position switching control of the control valve 13.

Incidentally, the hydraulic pump 11 is also cooperated by a pump pilot valve 24 that is operated by the control command from the control unit 23, and is set so that the discharge flow rate of the hydraulic oil is controlled in accordance with a manipulation amount of the manipulation lever 32.

Further, the control unit 23 determines whether the bucket 7 is located in the air or in contact with the ground on the basis of detection signals from the pressure detection sensors 28. The following examples are provided as means of determining presence or absence of the ground-contact.

First, when the bucket 7 is stopped in the air or is lowered in the air, the rod end oil passage 19 is closed by the discharge valve passage 22 of the control valve 13 being positioned at the neutral position N or receives the dead weight of the front work equipment 4 in a state of being subject to the flow rate restriction (flow rate control) by the lowering-side operating position D, and thereby a detection value of the pressure detection sensor 28 provided in the rod end oil passage 19 becomes high. In contrast, when the bucket 7 is in contact with the ground, the rod end oil passage 19 is released from receiving the dead weight thereof from the front work equipment 4, and thus a detection value of the pressure detection sensor 28 provided on the rod end oil passage 19 side becomes low. By discriminating presence or absence of this pressure change by the control unit 23, it is possible to determine whether the bucket 7 is in the air or is in contact with the ground.

Incidentally, when the boom 5 is lowered in order to carry out digging work (normal work) by the bucket 7, a powerful lowering control with the hydraulic oil being supplied from the hydraulic pump 11 is required. In this case, the head end oil passage 18 is supplied with the hydraulic oil from the hydraulic pump 11, and thus a detection value of the oil pressure detection sensor 28 provided in the head end oil passage 18 is high, while a detection value of the oil pressure detection sensor 28 provided in the rod end oil passage 19 is low because of entering in a state where the rod end oil passage 19 communicates with the oil tank 16. By discriminating this state, it becomes possible to detect that the digging work is underway.

Besides, a determination as to whether or not the bucket 7 is in contact with the ground is not limited to the one relying on such a pressure detection sensor 28. For example, swing angle sensors for detecting swing angles of the boom 5, the stick 6, and the bucket 7 are provided. The position of the bucket 7 can be calculated on the basis of a detection value by the swing angle sensor, so that it can be determined whether or not the bucket 7 is in contact with the ground. However, for such a ground-contact determination, it is needless to say that one or more of the already publicly known techniques can be adopted as appropriate.

The control unit 23 outputs control commands necessary for the respective pilot valves 14, 15, 24, and the float work switching valve 26, in response to signals that are input from the manipulation lever 32 and the mode switching tool 31 provided in the driver's cab 3*a*, by which the corresponding extension and contraction control of the boom cylinder 8 can be executed. The control unit 23 performs a mode discrimination (S1) whether an input signal selected in the mode switching tool 31 is the normal working mode or the float working mode.

Then, when it is determined as the normal working mode, the process shifts to a control routine of the normal working mode control (S2), and when it is determined as the float working mode, the process shifts to a control routine of the float working mode control (S3).

Next, a procedure for raising/lowering control of the boom 8 when each of the work modes is selected will be described, but here, the control from the state where the bucket 7 is located in the air will be described.

Then, when the normal working mode is selected as the work mode, it is determined at which manipulation position the manipulation lever 32 is positioned (S4). If positioned at a neutral position, the control unit 23 outputs a control command in order to switch the control valve 13 to the neutral position N (S5). If it is determined as a raising position, the control unit 23 outputs a control command in order to switch the control valve 13 to the raising-side operating position U (S6), so that the corresponding raising/lowering control of the boom 4 will be executed.

In contrast, if it is determined that the manipulation lever 32 is at a lowering position, it is further determined whether the pressure detection sensor 28 is in a ground-contact detected state (S7). If it is determined that the bucket 7 is not in contact with the ground, that is, the bucket 7 is located in the air, then the control unit 23 outputs a control command so that the control valve 13 is positioned at the first region D1 of the lowering-side operating position D (S8). On the contrary, if it is determined that the bucket 7 is in contact with the ground, the control unit 23 outputs a control command so that the control valve 13 is positioned at the second region D2 of the lowering-side operating position D (S9).

On the other hand, when the float working mode is selected, a manipulation position of the manipulation lever 32 is determined (S10), if it is determined as the neutral position N, the control unit 23 outputs a control command in order to switch the control valve 13 to the neutral position, and if it is determined as the raising position, to the raising-side operating position U (S11, S12).

In contrast, if it is determined that the manipulation lever 32 is in the lowering position, the control valve 13 is controlled to be positioned at the first region D1 of the lowering-side operating position D, but in this float working mode, regardless of whether or not the bucket 7 is in contact with the ground, that is, regardless of whether or not the pressure detection sensor 28 detects the ground-contact, if the manipulation lever 32 is at the lowering position, the control valve 13 is controlled to be maintained at the position of the first region D1.

Incidentally, the control unit 23, in a state of having output a control command so that the control valve 8 is positioned at the first region D1 of the lowering-side operating position D, regardless of the selected work mode, is set to output a control command to the pump pilot valve 24 in order to place the hydraulic pump 11 in an unload state in which effective hydraulic oil supply to the control valve 13 side is not available.

In the embodiment of the present invention configured as described above, when performing a normal work such as digging work using the bucket 7, or when performing a float work such as spreading and grading work, respective corresponding works will be performed by switching the mode switching tool 31 to the normal working mode, the float working mode.

Now, in a state of having switched to the float working mode in order to perform a float work, when the bucket 7, which is being raised in the air, is lowered to contact the ground, and a lowering manipulation of the manipulation lever 32 is performed in order to perform a float work in this ground-contact state, the control unit 23 outputs a control command to the lowering pilot valve 15 and the float work switching valve 26.

The lowering pilot valve 15, which has received the control command from the control unit 23, will supply a pilot oil corresponding to the control command to the control valve 13, and the control valve 13, which has received this pilot oil, enters a state of a spool displacement amount corresponding to a lever manipulation amount at the first region D1 of the lowering-side operating position D, and the regeneration valve passage 20 enters an opened state at a corresponding valve passage opening area, while the anti-descend valve 25 is switched to the communication position 25*b*.

As a result, in a state of the first region D1, the hydraulic oil in the head end oil chamber 8*a* will be supplied to the rod end oil chamber 8*b* routed through the regeneration valve passage 20 on the basis of receiving the dead weight of the front work equipment 4, and thereby the boom cylinder 8 will be contracted and the boom 5 will descend, but an excess hydraulic oil at this time is discharged to the oil tank 16 via the discharge oil passage 22.

Furthermore, in this case, the float work switching valve 26 which has received the control command from the control unit 23 will be switched between valve positions from the make-up position 26*b* to the communication position 26*a*. If there is an excess or deficiency in the hydraulic oil in the rod end oil chamber 8*b*, it is configured such that the hydraulic oil from the oil tank 16 is supplied or discharged. Incidentally, if there is an excess or deficiency in the hydraulic oil in the head end oil chamber 8*a*, it is configured such that the hydraulic oil from the line relief valve 27 is supplied or discharged.

Then, in the float working mode, even after the bucket 7 has contacted the ground, while the manipulation lever 32 is under a lowering manipulation, the control valve 8 remains positioned at the first region D1 as it is and the lowering control in a float working state by the dead weight of the front work equipment 4 will be continuously executed. As a result, in the float working mode, even after the bucket 7 located in the air is lowered to contact the ground, the control valve 8 is such that a lowering control state at the first region D1 of the lowering operation position D will be sustained as it. Thus, the conventional valve passage switching is not performed, and the float work without feeling a sense of discomfort can be continued, thereby improving the operability.

In such a float work, if a load in a direction of raising the bucket 7 against the dead weight of the front work equipment 4 acts from a working plane side due to undulations of the working plane (ground-contact plane) or the like, the load turns into a load in a direction of raising the boom 5, in other words, in a direction of extending the boom cylinder 8.

In response to this, the hydraulic oil in the rod end oil chamber 8*b* is discharged into the oil tank 16 via the valve passage of the switched communication position 26*a* of the float work switching valve 26, while the hydraulic oil will be supplied from the oil tank 16 to the head end oil chamber 8*a* via the valve passage of the line relief valve 27 with the make-up function, the communication position 25*b* of the anti-descend valve 25 provided in the head end oil passage 18, and the boom cylinder 8 is thereby extended and the boom 5 is raised, so that the float work can be performed without hindrance.

In contrast, when the normal working mode is selected, in a state where the manipulation lever 32 is under a lowering manipulation and the bucket 7 is lowered in the air, the control unit 23 execute a lowering control by causing the control valve 8 to be positioned at the first region D1 of the lowering operation position D as described above. When a ground-contact of the bucket 7 is detected, the control unit 23 executes a lowering control by causing the control valve 8 to be positioned at the second region D2 of the lowering operation position D. This allows a lowering work to be performed by a strong power supplied with the hydraulic oil from the hydraulic pump 11, and thereby the normal work such as digging and the like using the bucket 7 is not hindered.

Then, the operation of the bucket 7 being lowered in the air in the normal working mode is an operation by the lowering control at the first region D1 of the lowering operation position D, similarly to a front working mode, which can be made common. This allows, regardless of the selection of the work mode, the lowering operation of the bucket 7 to be performed in the same manner by the same manipulation, and thus the operability is excellent without feeling a sense of discomfort.

Moreover, in this case, even if a shock occurs by switching from the first region D1 to the second region D2 in the lowering operation position D, associated with the detection of the bucket 7 having contacted the ground, this switching is overlapped with the timing of commencing normal ground working such as digging work by the bucket 7, and therefore the shock is not likely to pose problems of workability or operability.

Besides, in this case, when lowering the bucket 7 in the air, the control valve 8 is positioned at the first region D1 of the lowering operation position D regardless of the selection of the work mode, and the hydraulic pump 11 is in an unload state, and therefore energy saving can be achieved including the case where the float working mode is selected, and fuel efficiency is also improved.

INDUSTRIAL APPLICABILITY

The present invention can be utilized, in a construction machine such as a hydraulic excavator, as a boom control device in a construction machine comprising a boom that is movable upwardly and downwardly on the basis of the extending and contracting operation of the boom cylinder.

The invention claimed is:

1. A construction machine comprising:

a front work equipment with a boom being supported by a machine body so as to be swingable upwardly and downwardly;

a boom cylinder configured to cause the boom to swing upwardly and downwardly;

a control valve configured to perform extension and retraction control of the boom cylinder;

a control unit configured to perform a switching control of the control valve;

a ground-contact detecting means for detecting a ground-contact of a work attachment provided at a leading end portion of the front work equipment; and the control unit configured to output a control command to the control valve in response to a manipulation tool, the construction machine being configured such that:

the control unit is set to be capable of switching work modes of the front work equipment between a normal working mode that is set at a time of a normal work in which a lowering control of the front work equipment is performed in a state where a hydraulic oil supply from a hydraulic pump is possible, and a float working mode that is set at a time of a float work performed in a state where the hydraulic oil supply from the hydraulic pump is shut off and a dead weight of the front work equipment is received, and the control valve is capable of making a valve position switching among a neutral position at which the extension and retraction of the boom cylinder is stopped, a raising-side operating position at which the boom cylinder is extended to raise the boom, and a lowering-side operating position at which the boom cylinder is contracted to lower the boom, in response to the control command from the control unit, wherein:

the control valve comprises, at the lowering-side operating position, a discharge valve passage that allows the hydraulic oil in a head end oil chamber of the boom cylinder to be discharged into an oil tank; a regeneration valve passage with a check valve that allows the hydraulic oil in the head end oil chamber to be supplied to a rod end oil chamber; and a supply valve passage for supplying the hydraulic oil from the hydraulic pump to the rod end oil chamber; wherein the lowering-side operator position has a first region and a second region, and the hydraulic oil supply from the hydraulic pump by the supply valve passage is shut off at the first region and allowed at the second region, if the work mode when the control valve is positioned at the lowering-side operating position is in the normal working mode, the control unit is set to perform a lowering control of the front work equipment at the first region when the ground-contact detecting means is in a ground-contact non-detected state, and performs the lowering control at the second region when the ground-contact detecting means is in a ground-contact detected state;

if the work mode when the control valve is positioned at the lowering-side operating position is in the float working mode, the control unit is set to perform the lowering control at the first region notwithstanding the ground-contact detected state by the ground-contact detecting means.

2. The boom control device in a construction machine according to claim 1, wherein the control unit is configured to control a pump pilot valve so that the hydraulic pump is set into an unload state when the control valve is positioned at the first region.

* * * * *